US005169252A

United States Patent [19]

Chappell

[11] Patent Number: 5,169,252

[45] Date of Patent: Dec. 8, 1992

[54] CLEANING IMPLEMENT WITH AUTOMATIC HAND REGULATED SHUT-OFF

[75] Inventor: Gilmore H. Chappell, Depford, N.J.

[73] Assignee: Chappell International, Inc., Westville, N.J.

[21] Appl. No.: 763,876

[22] Filed: Sep. 20, 1991

Related U.S. Application Data

[63] Continuation of Ser. No. 659,447, Feb. 22, 1991, abandoned, and Ser. No. 307,054, Feb. 6, 1989, abandoned, which is a continuation-in-part of Ser. No. 97,132, Sep. 16, 1987, abandoned, and a continuation-in-part of Ser. No. 263,958, Oct. 26, 1988, Pat. No. 4,895,468, which is a continuation of Ser. No. 45,323, May 4, 1987, abandoned, and a continuation-in-part of Ser. No. 282,987, Dec. 2, 1988, abandoned, which is a continuation of Ser. No. 165,636, Mar. 8, 1988, abandoned, and a continuation-in-part of Ser. No. 163,066, Mar. 2, 1988, abandoned, and Ser. No. 163,065, Mar. 2, 1988, abandoned.

[51] Int. Cl.[5] ..... A46B 11/02; A46B 11/06

[52] U.S. Cl. ..... 401/46; 401/42; 401/136; 401/139; 401/204; 401/270; 401/272; 401/273; 401/266; 401/274; 401/275; 401/279; 401/289; 401/24; 401/27

[58] Field of Search ..... 401/42–47, 401/148, 270, 272, 273, 274, 275, 278, 279, 289, 204, 266, 136, 139, 24, 27

[56] References Cited

U.S. PATENT DOCUMENTS

| | | | |
|---|---|---|---|
| Re. 308,491 | 1/1982 | Crist . | |
| 595,012 | 12/1897 | Barrett . | |
| 656,759 | 8/1900 | Wirt . | |
| 665,631 | 1/1901 | Duffus . | |
| 703,103 | 6/1902 | Weber . | |
| 794,638 | 7/1905 | Payn | 401/46 |
| 832,656 | 10/1906 | Cook | 401/42 |
| 1,099,262 | 6/1914 | Martin et al. . | |
| 1,181,594 | 5/1916 | Hinkle . | |
| 1,188,262 | 6/1916 | Frederick | 401/288 |
| 1,244,833 | 10/1917 | Burich . | |
| 1,372,125 | 3/1921 | Dreier . | |
| 1,510,898 | 10/1924 | Nikicser . | |

(List continued on next page.)

FOREIGN PATENT DOCUMENTS

| | | | |
|---|---|---|---|
| 519342 | 12/1955 | Canada . | |
| 813149 | 7/1949 | Fed. Rep. of Germany . | |
| 881035 | 6/1953 | Fed. Rep. of Germany | 401/204 |
| 927621 | 5/1955 | Fed. Rep. of Germany . | |
| 2153439 | 5/1972 | Fed. Rep. of Germany . | |
| 2203968 | 8/1973 | Fed. Rep. of Germany . | |
| 548042 | 12/1922 | France | 401/288 |
| 555143 | 6/1923 | France | 401/275 |
| 852547 | 2/1940 | France . | |
| 935231 | 2/1948 | France | 401/46 |
| 1239099 | 7/1960 | France . | |
| 566018 | 1/1956 | Italy . | |
| 6500078 | 1/1966 | Netherlands . | |

*Primary Examiner*—Steven A. Bratlie
*Attorney, Agent, or Firm*—Panitch, Schwarze, Jacobs & Nadel

[57] ABSTRACT

A cleaning implement is provided with an internal valve for automatic water shut-off which can be regulated by hand. The implement connects to a conventional water supply, for example, a garden hose. When the valve is open, water is supplied through a removable sponge or brush to a surface to be cleaned. The valve is opened when two portions of the implement are pivoted with respect to each other. This can be done by pressing the sponge or brush against a surface to be cleaned, pivoting the two portions of the implement and thereby opening the valve. Alternatively, the two portions can be held by handles, one in either hand, and pivoted to open and close the valve. An opening is provided in the brush or sponge to allow water to stream from a nozzle to the surface to be cleaned, unobstructed. A soap dispenser is also incorporated into the implement. The nozzle and soap dispenser direct fluid from the user when the implement is held in the hands. The implement may be used with other fluids not water.

16 Claims, 14 Drawing Sheets

U.S. PATENT DOCUMENTS

| | | | |
|---|---|---|---|
| 1,970,279 | 8/1934 | Creveling . | |
| 1,970,831 | 8/1934 | Allen . | |
| 2,037,023 | 4/1936 | Holby . | |
| 2,133,147 | 10/1938 | Mortimore . | |
| 2,164,432 | 4/1939 | Selwyn . | |
| 2,206,208 | 7/1940 | Thomas | 401/148 |
| 2,234,386 | 3/1941 | Schaub et al. . | |
| 2,250,878 | 7/1941 | Quaranti | 401/47 X |
| 2,254,069 | 8/1941 | Harris . | |
| 2,281,484 | 4/1942 | Ellinger . | |
| 2,441,704 | 5/1948 | Jackson . | |
| 2,456,687 | 12/1948 | Dominguez . | |
| 2,512,281 | 6/1950 | Loftstrand, Jr. . | |
| 2,525,615 | 10/1950 | Peck . | |
| 2,584,630 | 2/1952 | Soss | 401/46 X |
| 2,584,631 | 2/1952 | Soss . | |
| 2,603,805 | 7/1952 | Maestas . | |
| 2,683,886 | 7/1954 | Neumann . | |
| 2,797,132 | 6/1957 | Alpert . | |
| 2,802,481 | 8/1957 | Jahn . | |
| 2,805,435 | 9/1957 | Boscarino, Jr. . | |
| 2,830,614 | 4/1958 | Pralle . | |
| 2,877,480 | 3/1959 | Warren . | |
| 2,922,425 | 1/1960 | Lerner et al. . | |
| 2,997,732 | 8/1961 | Gilchrist et al. . | |
| 3,016,605 | 1/1962 | Heckethorn . | |
| 3,089,181 | 5/1963 | Hess | 401/203 X |
| 3,107,861 | 10/1963 | Penkoff . | |
| 3,145,724 | 8/1964 | Pelzer . | |
| 3,256,893 | 6/1966 | McEachran . | |
| 3,273,757 | 9/1966 | Moen . | |
| 3,357,604 | 12/1967 | Barker . | |
| 3,476,105 | 11/1969 | Abramowitz . | |
| 3,552,870 | 1/1971 | Brooks . | |
| 3,618,629 | 11/1971 | Heyer et al. . | |
| 3,642,181 | 2/1972 | Thomas et al. . | |
| 3,669,138 | 6/1972 | Schoepe et al. . | |
| 3,670,760 | 6/1972 | Butcher et al. . | |
| 3,748,678 | 7/1973 | Ballou . | |
| 3,775,017 | 11/1973 | Jerry . | |
| 3,879,139 | 4/1975 | Dahl et al. . | |
| 3,888,461 | 6/1975 | Bron . | |
| 3,943,591 | 3/1976 | Lanusse . | |
| 3,989,391 | 11/1976 | Thorner . | |
| 4,084,281 | 4/1978 | Smith . | |
| 4,175,300 | 11/1979 | McGlew et al. . | |
| 4,217,059 | 8/1980 | Shelton . | |
| 4,236,840 | 12/1980 | Kennedy . | |
| 4,265,560 | 5/1981 | Spica . | |
| 4,312,598 | 1/1982 | Vagner . | |
| 4,407,213 | 10/1983 | Evans . | |
| 4,417,826 | 11/1983 | Floros . | |
| 4,532,666 | 8/1985 | Smyth . | |
| 4,594,015 | 6/1986 | Pomares . | |
| 4,611,941 | 9/1986 | Karliner et al. . | |
| 4,629,347 | 12/1986 | Poppitz . | |
| 4,764,047 | 8/1988 | Johnston et al. . | |
| 4,826,340 | 5/1989 | Rothweiler et al. . | |

CLEANING IMPLEMENT WITH AUTOMATIC HAND REGULATED SHUT-OFF

CROSS-REFERENCE TO RELATED APPLICATIONS

This is a continuation of application Ser. No. 07/659,447, filed Feb. 22, 1991 abandoned and Ser. No. 07/307,054Filed Feb. 6, 1989, abandoned which is a continuation-in-part of U.S. patent application Ser. No. 097,132, filed Sep. 16, 1987 entitled Cleaning Implement with Automatic Water Shut-Off (now abandoned); and a continuation-in-part of U.S. patent application Ser. No. 263,958, filed Oct. 26, 1988 entitled Brush with Automatic Water Shut-Off, (Pat. No. 4,895,468) which is a continuation of U.S. patent application Ser. No. 045,323, filed May. 4, 1987 (now abandoned); and a continuation-in-part of U.S. patent application Ser. No. 282,987, filed Dec. 2, 1988 entitled Automatic Fluids Valve, (now abandoned) which is a continuation of U.S. patent application Ser. No. 165,636, ,filed Mar. 8, 1988 entitled Automatic Water Valve (now abandoned); and a continuation-in-part of U.S. Design patent applications Ser. No. 163,066, filed Mar. 2, 1988 entitled Cleaning Implement and Ser. No. 163,065, filed Mar. 2, 1988 entitled Water Controlled Cleaning Implement (both now abandoned). The disclosure of each of the aforementioned applications is incorporated herein by reference.

This patent application discloses common subject matter to co-pending patent application entitled Automatic Fluid Valve, filed on even date herewith, U.S. Ser. No. 307,004 (U.S. Pat. No. 4,958,803), the disclosure of which is incorporated by reference herein.

FIELD OF THE INVENTION

The present invention relates generally to the field of brushes and cleaning implements, and more particularly, is directed to cleaning elements with automatic water shut-off, which are adapted to be connected to conventional garden hoses.

DESCRIPTION OF THE PRIOR ART

It is known to employ various types of cleaning implements which are adapted for connection to a source of water under pressure, for example a conventional garden hose. Such cleaning implements usually comprise brushes having bristles suitable for cleaning polished surfaces without scratching, such as the painted and polished surfaces of motor vehicles and similar flat or curved surfaces which may be conveniently cleaned using water.

Various types of car cleaning brushes suitable for water hose attachment have been developed by prior workers in the art and some such brushes, for example the brush disclosed in U.S. Pat. No. 4,532,666, includes a turbine type of construction wherein at least a portion of the brush is rotated by the water under pressure as it passes through the brush.

Home cleaning implements with shut-off valves are known. By way of example, U.S. Pat. No. 1,181,594 to Hinkle discloses a valve in a floor brush in which a rod connected to a disk-shaped shut-off member in a water flow passage, is cam actuated when a long handle, connected to the floor brush, is pivoted relative to the floor brush. The valve is cam operated to an open condition allowing water flow into a cavity as the handle is rotated toward the floor towards a position more closely aligned with the horizontal plane of the floor and brush. Water flows out of the bristles of the brush from the cavity by pushing down on a piston type cover over the cavity with the handle.

Despite the variety of prior art water equipped brushes that have been developed to date, the need remains to provide an improved low cost hand held brush having suitable valve means within the brush itself to permit control of the flow of water directly at the cleaning site in the hands of the user.

SUMMARY OF THE INVENTION

An embodiment of the present invention is a hand held cleaning implement which includes an integral automatic shut-off valve. The user operates the valve either by applying the cleaning implement to a surface to be cleaned or by holding it in the user's hands and manipulating two portions of the implement with the hands.

One embodiment of the invention is a hand held cleaning implement for applying fluid to a surface. A body portion has a cleaning element mounted thereon. A fluid discharge nozzle is disposed for passing fluid past the mounted cleaning element to directly impinge on the surface. A handle portion is pivotally coupled to the body portion and has an inlet. The handle and body portions are pivotable between deactuated and actuated conditions. A conduit directs fluid flow from the inlet out of the nozzle. A valve coupled to the handle and body portions and is operative in the deactuated condition for blocking fluid flow through the conduit. The body and handle portion are relatively disposed so that a user may grasp each, one in each hand, and simultaneously move the handle and body portions, relative to each other, causing pivoting to such actuated condition, thereby causing the valve to open and allow fluid to be passed out of the nozzle in a direction away from the user.

One embodiment of the invention is a method for rinsing a surface with a cleaning element, having first and second relatively pivotal portions and a cleaning element on one of said portions. The steps are as follows: A user grasps in one hand one of the pivotal portions and in the other hand, a second one of the pivotal portions and holds the cleaning element suspended. The user then pivots the first and second pivotal portions relative to each other, while dispensing fluid past the cleaning element, away from the user, to directly impinge on the surface to be rinsed. As a result, a very simple and efficient method is disclosed for rinsing with a cleaning element.

One embodiment of the invention is a hand held cleaning implement for separately scrubbing and rinsing a surface. A body portion has a side on which is mounted a cleaning element. A fluid discharge nozzle passes fluid past the cleaning element to directly impinge on the surface to be cleaned. A handle portion is pivotally connected to the body portion and the handle and body portions are pivotable between deactuated and actuated conditions. The handle portion has a fluid inlet and a conduit directs fluid flow from the inlet out through the nozzle. A valve is operatively coupled to the handle and body portions and is operative in the deactuated condition for blocking fluid flow through the conduit.

A further handle portion is provided on the body portion so that a user may grasp the handle and handle portion, one in each hand, and simultaneously move the handle and body portions relative to each other, preferably toward the user. This causes a pivoting to the actuated condition and causes the valve to open and allow fluid to be passed out of the nozzle in a direction away from the user.

Preferably the further handle is disposed at or near the end of the body portion and the handle and body portions extend end to end in substantially opposite directions. Preferably the fluid passes from the nozzle and directly impinges on the surface without substantially contacting the cleaning element. Preferably the cleaning element is a brush with bristles or a sponge. An opening is provided through the bristles and in the sponge around the nozzle. The cleaning implement preferably has a soap dispenser for dispensing soap to the cleaning element. Preferably the soap dispenser includes a soap reservoir and a soap discharge chamber separated by a weir, the soap discharge chamber being in direct communication with an opening for dispensing the soap.

The cleaning implement also preferably comprises a chamber with a seat within the conduit of the handle portion. A moveable valve member in the chamber is provided for seating against the seat and blocking the flow of fluid in the conduit. A rod extends in the conduit and is operated under the influence of the pivoting of the handle and body portions for axially moving and forcing the valve member away from the seat to allow fluid flow. The cleaning implement also preferably has a tubular shaped member connected to one of the handle and body portions This member is slidable within and in sealing engagement with a bore in a conduit during pivoting for passing fluid between the two portions in the conduit. Preferably, the fluid normally urges the valve to the seated condition, blocking the flow of fluid and forcing the handle and body portions to the deactuated condition.

An embodiment of the invention is a hand held scrubbing and rinsing implement. A fluid conduit has an inlet and an outlet between which fluid is passed. A connector couples the inlet to a source of the fluid. A resilient cleaning element is coupled to the conduit for scrubbing a surface to be cleaned. A nozzle passes a spray of fluid from the outlet past the cleaning element so as to directly impinge on the surface being cleaned while the brush is removed from the surface. Preferably, the nozzle is adapted to provide a fan shaped spray of fluid passed the cleaning element. Also preferably, the cleaning element has a scrubbing side and an opening through the cleaning element and said side. The said opening is adapted to permit the spray of fluid to pass through the element and directly impinge on the surface. Preferably, a controllable valve controls fluid flow through the conduit.

BRIEF DESCRIPTION OF THE DRAWINGS

A fuller understanding of the invention will be had by referring to the following description and claims of preferred embodiments thereof, taken in conjunction with the accompanying drawings, wherein like reference characters refer to similar parts throughout the several views and in which:

DETAILED DESCRIPTION OF THE PREFERRED EMBODIMENTS

Figure 1:
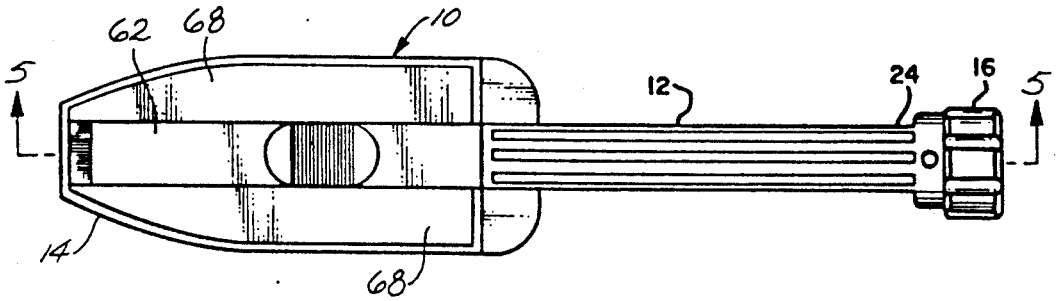
FIG. 1 is a top plan view of a cleaning implement with automatic water shut-off in accordance with the present invention.

There is shown in FIG. 1 a novel cleaning element 10 which comprises generally a handle portion 12 and a pivotally interconnected body portion 14. The handle portion 12 terminates rearwardly in a threaded socket 16 which is suitable for interconnection to the threaded end of a usual garden hose (not shown) in a conventional manner.

Figure 5:
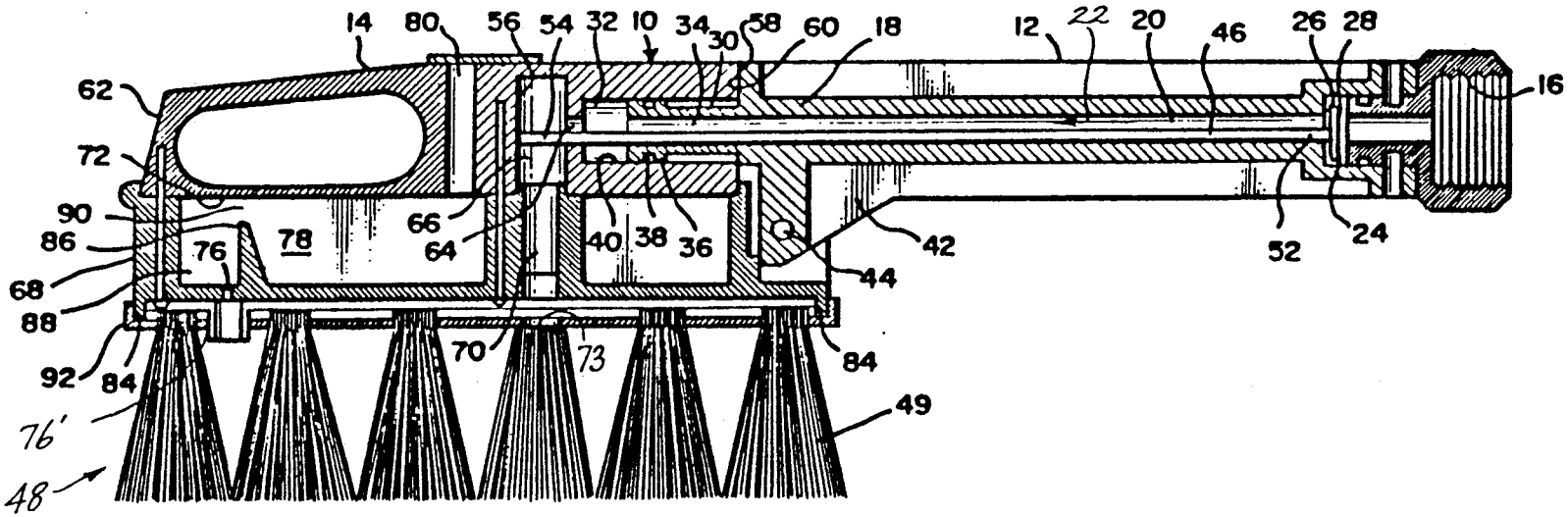
FIG. 5 is a cross sectional view taken along 5—5 on FIG. 1, looking in the direction of the arrows, showing the arrangement of parts with the valve open.
Figure 6:
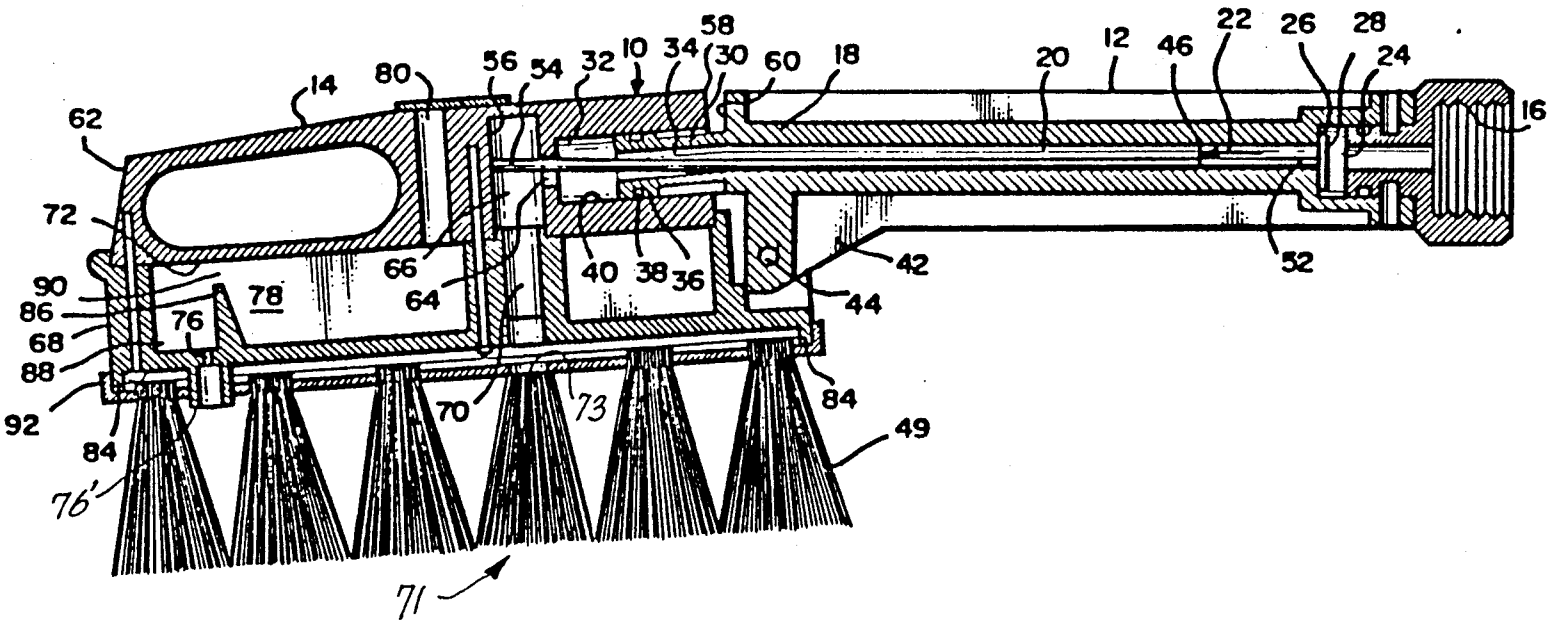
FIG. 6 is a cross sectional view similar to FIG. 5, showing the arrangement of parts with the valve closed.

As best seen in FIGS. 5 and 6, the handle portion 12 is provided with an axial water conduit 20 to permit water flow therethrough in the direction indicated by the arrow 22. The conduit 20 is in fluid communication with the threaded socket 16 and terminates rearwardly in a valve chamber 24, which chamber is intended to normally be filled with water under all conditions of use. The valve chamber 24 terminates forwardly in a circular, planar seat 26 of size and configuration to receive thereon a flutter valve 28 in sealing engagement. Preferably, the flutter valve 28 is not connected within the valve chamber 24. Preferably, the valve is not connected to rod 46 and the flutter valve is not captured immovably against the rod. Thus, the flutter valve is free to move in the chamber 24 between seated and unseated positions to control the flow of water through the cleaning implement 10.

As illustrated in FIG. 6, when the cleaning implement 10 is not in use, water under pressure will impinge upon the loose flutter valve 28 and will force the valve through the valve chamber 24 until it presses upon and seals against the seat 26. When the flutter valve 28 is pressed against the seat 26, water flow through the brush 10 will be interrupted and this construction will function as an automatic shut-off, without requiring any attention on the part of the user.

Still referring to FIGS. 5 and 6, the forward end 18 of the handle portion 12 is integrally formed with an extending nozzle 30 which projects interiorly of the body portion 14. As shown, the body portion 14 includes a cooperating, hollow conduit 32 to receive water under pressure from the handle portion 12. The handle portion nozzle 30 includes an interior water conveying bore or conduit 34, which conduit forms an extension of the handle portion conduit 20 and intercommunicates between the valve chamber 24 and the body portion bore 32. As shown, the nozzle 30 is formed with a peripheral groove 36 to receive therein a rubber 0-ring seal 38 or other suitable elastomeric type of sealing construction. The 0-ring seal 38 bears against the inner periphery 40 of the body portion conduit 32 to prevent any backflow or loss of water at the interconnection between the handle portion 12 and the body portion 14 under all pivoted positions of use.

A pair of connecting lugs 42 (only one shown by way of illustration) forwardly project from the handle portion 12 below the water conduit 20 and into recesses provided in the body 68 of the body portion 14. A pivot pin 44 extends through the body 68 and the lugs 42 to allow limited pivotal movement between the handle portion 12 and the body portion 14. As illustrated in FIG. 5, when the cleaning implement 10 is in its initial deactuated or unused condition, the handle portion 12 is normally angularly cocked relative to the body portion 14 about the pivot pin 44. The angularity is produced by the rearward end 52 of the valve operating rod 46 contacting the flutter valve 28. Water pressure upon the flutter valve 28 will urge the flutter valve 28 tightly against its seat 26. This will result in automatic water shutoff inasmuch as the water conduit 20 will be isolated from water introduced at the threaded socket 16 by the flutter valve 28 Additionally, the action of the water pressure upon the flutter valve will cause the flutter valve 28 to urge the operating rod 46 forwardly. The interaction of the operating rod forward end 54 against the stationary barrier 56 will cause the body portion 14 to pivot about the pin 44. With the parts angularly cocked as shown in FIG. 6, the seat 26 will be pivoted away from the rear of the operating rod 46 whereby the flutter valve 28 will be free to seal against the seat 26 under the impetus of the water pressure.

The valve operating rod 46 is free to be axially moveable through the conduits 20, 32 and 34 and opening 64. The operating rod may be fabricated of metal or hard plastic and is normally positioned so that its valve contact or rearward end 52 extends rearwardly beyond the seat 26 when the parts are axially aligned in an actuated condition as in FIG. 5. This forces the flutter valve 28 away from the seat 26, thereby allowing water to freely flow through the brush. The forward end 54 of the valve operating rod 46 abuts against the barrier 56 which is interiorly provided in the body portion 14 to thereby positively limit the forward travel of the operating rod 46 within the aligned water passage conduits 20, 32 and 34 and opening 64. When the cleaning implement 10 is not applied against a surface to be cleaned or pivoted for rinsing (to be described), the forward pressure of the flutter valve 28 upon the operating rod 46 will be sufficient to angularly move the body portion 14 about the pivot pin 44 relative to the handle portion 12 to the deactuated condition to allow the flutter valve 28 to seal upon its seat 26, thereby automatically stopping the flow of water.

Figure 2:
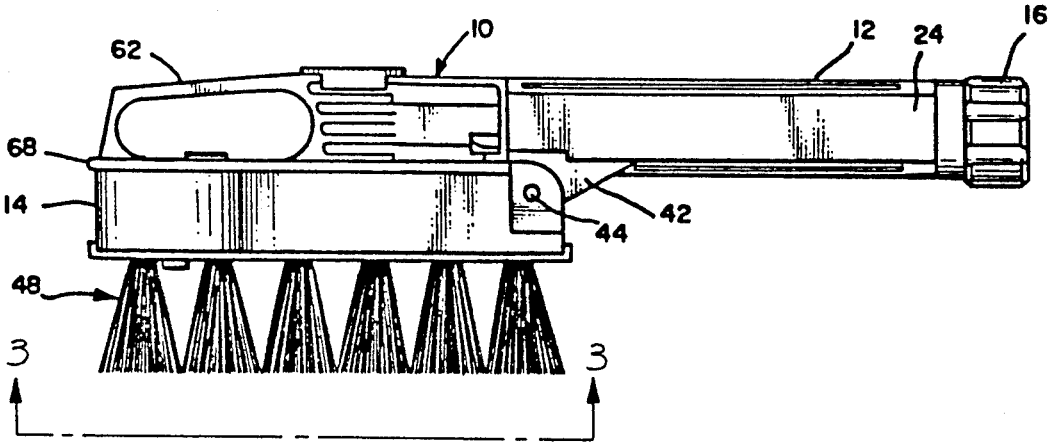
FIG. 2 is a side elevational view of the cleaning implement of FIG. 1, showing a brush as the cleaning element.
Figure 3:
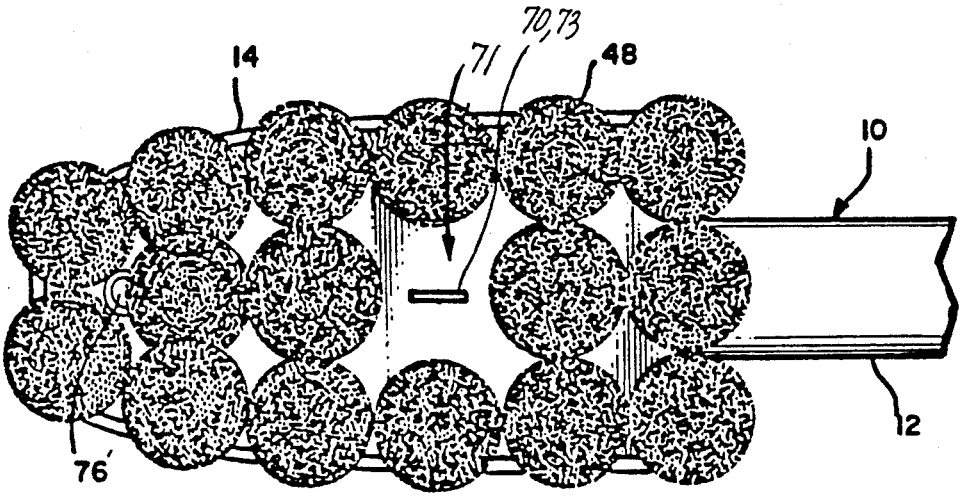
Figure 4:
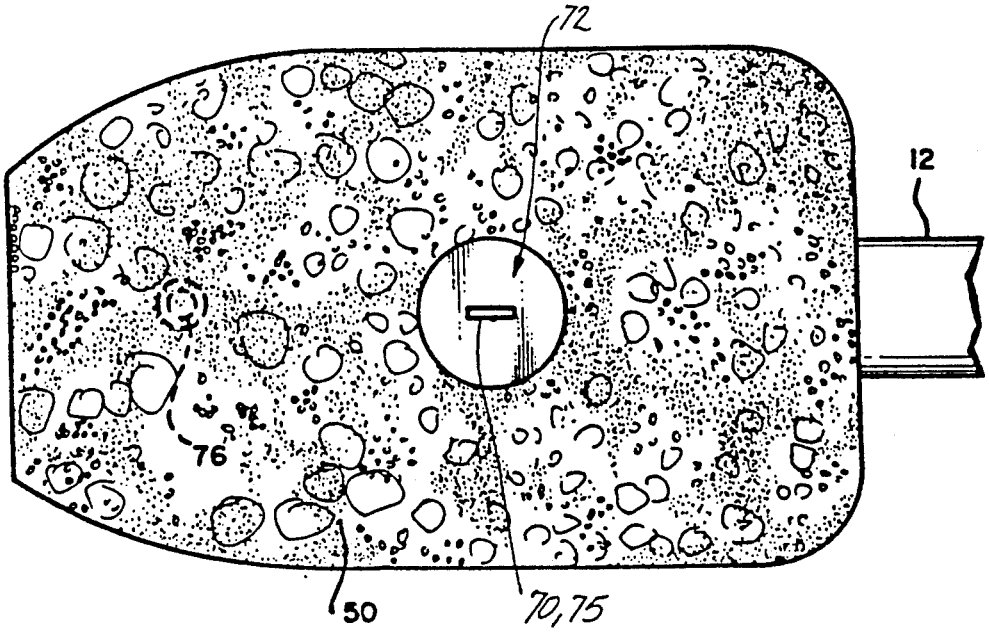
FIG. 4 is a bottom plan view similar to FIG. 3 showing a sponge as the cleaning element.

When the body portion 14 is employed for cleaning purposes by applying either the brush 48 (FIGS. 2, 3) or the sponge 50 (FIG. 4) against the surface to be cleaned, the application of forces on handle portion 12 by the user will easily be sufficient to overcome the impetus of the water pressure upon the flutter valve 28. This will cause the body portion 14 to pivot in a clockwise direction relative to the handle portion 12 about the pivot pin 44 until the rear wall 58 or stop of the body portion 14 abuts and stops against the forward stop or flange 60 of the handle portion 12. With the parts in this position, as illustrated in FIG. 5, the conduits 20, 32, 34 will all be in axial alignment and the barrier 56 will be pivoted to the closest possible position to the valve seat 26. Accordingly, the barrier 56 will urge the operating rod 46 to its rearwardmost position whereby the rearward end 52 of the operating rod will be pushed rearwardly past the plane of the valve seat 26. The operating rod will thereby automatically force the flutter valve 28 from the seat, thus causing automatic flow of water through the cleaning implement. Under this condition, water can be made to flow continuously through the cleaning implement 10 for application upon a car or other surface (not shown). It is noteworthy that the removal of the brush 48 or sponge 50 from the surface being cleaned will allow the water pressure upon the flutter valve 28 to forwardly urge the operating rod 46, thereby causing counter-clockwise rotation of the body portion 14 relative to the handle portion 12 about the pivot pin 44. See FIG. 6. In this condition, the rearward end 52 of the operating rod will be urged forwardly of the plane of the valve seat 26, thereby allowing the flutter valve 28 to contact the seat 26 and automatically stop water flow.

A preferred embodiment of this invention has an interchangeable brush 48 or sponge 50 for use with the body portion 14, depending upon the nature of the surface to be cleaned. In the illustrated embodiment, the body portion 14 is provided with a depending skirt 84 to removably receive thereon a tight-fitting, peripheral flange 92 which can be cooperatively formed in the brush 48 or sponge 50. In this manner, either the brush 48 or sponge 50 can be easily removably affixed to the body portion 14. Preferably a pull tab (not shown) or similar construction can be provided with the sponge 50 to facilitate separating the peripheral flange 92 from the body portion depending skirt 84. Alternatively, other separable fasteners, for example, "VELCRO" type fasteners can be employed to removably secure a brush 48 or sponge 50 to the body 68.

Referring still to FIGS. 5 and 6, the body portion 14 is formed with a generally hollow body 68 having a convenient handle 62 formed adjacent its end that is opposite from the handle portion. The body 68 is provided with a discharge opening or nozzle 70 which is in fluid communication with the hollow conduit 32 of the body portion 14 through an axially aligned opening and a directional chamber 66. Accordingly, when the flutter valve 28 is upset or forced off of its seat 26, water will flow through the handle portion 12 as indicated by the arrow 22, through the conduits 20, 32 and 34, through the opening 64 and directional chamber 66 and then through the discharge opening or nozzle 70 and then through opening 70' in the base of the brush 48 or opening 70" in the base of the sponge 50 to directly impinge upon the surface to be cleaned. The water (not indicated) under pressure will change direction within the directional chamber 66 without significant loss of pressure to thereby exit the nozzle 70 as a stream.

A hollow liquid soap or detergent receiving reservoir 78 is formed in the body 68 and is provided with a fill opening 80 to receive therein a conventional liquid soap or detergent (not shown) to aid in the cleaning process. An internal wall or weir 86 subdivides the detergent reservoir 78 to define a smaller soap discharge chamber 88. The weir 86 defines an upper soap passageway 90 between the top of the weir and the upper wall 72 of the reservoir 78 so that by vertically downwardly tilting the body portion 14, liquid soap or detergent can be made to flow from the reservoir 78 into the soap discharge chamber 88. The soap discharge chamber 88 is provided with a gravity soap discharge opening 76 whereby any soap which is allowed to spill over into the soap discharge chamber 88 can flow by gravity through the discharge opening 76 and, through opening 76' in the brush base or opening 76" in the sponge base, and thence into the brush 48 or sponge 50 for application upon the surface being cleaned.

In use, a garden hose 82 is connected to the threaded socket 16 in the usual manner and water under pressure impinges upon the flutter valve 28. With the brush 48 or sponge 50 not in contact with any surface to be cleaned, the water under pressure will be sufficient to force the flutter valve 28 against the seat 26 and against the rearward end 52 of the operating rod 46. The water pressure will force the body portion 14 and handle portion 12 to respectfully pivot about the pivot pin 44 relative to each other until the flutter valve 28 tightly seals upon the seat 26, thereby preventing water flow through the cleaning element 10. In this condition, the handle portion 12 will be angularly cocked relative to the body or brush portion 14 in the manner illustrated in FIG. 5.

Figure 7:
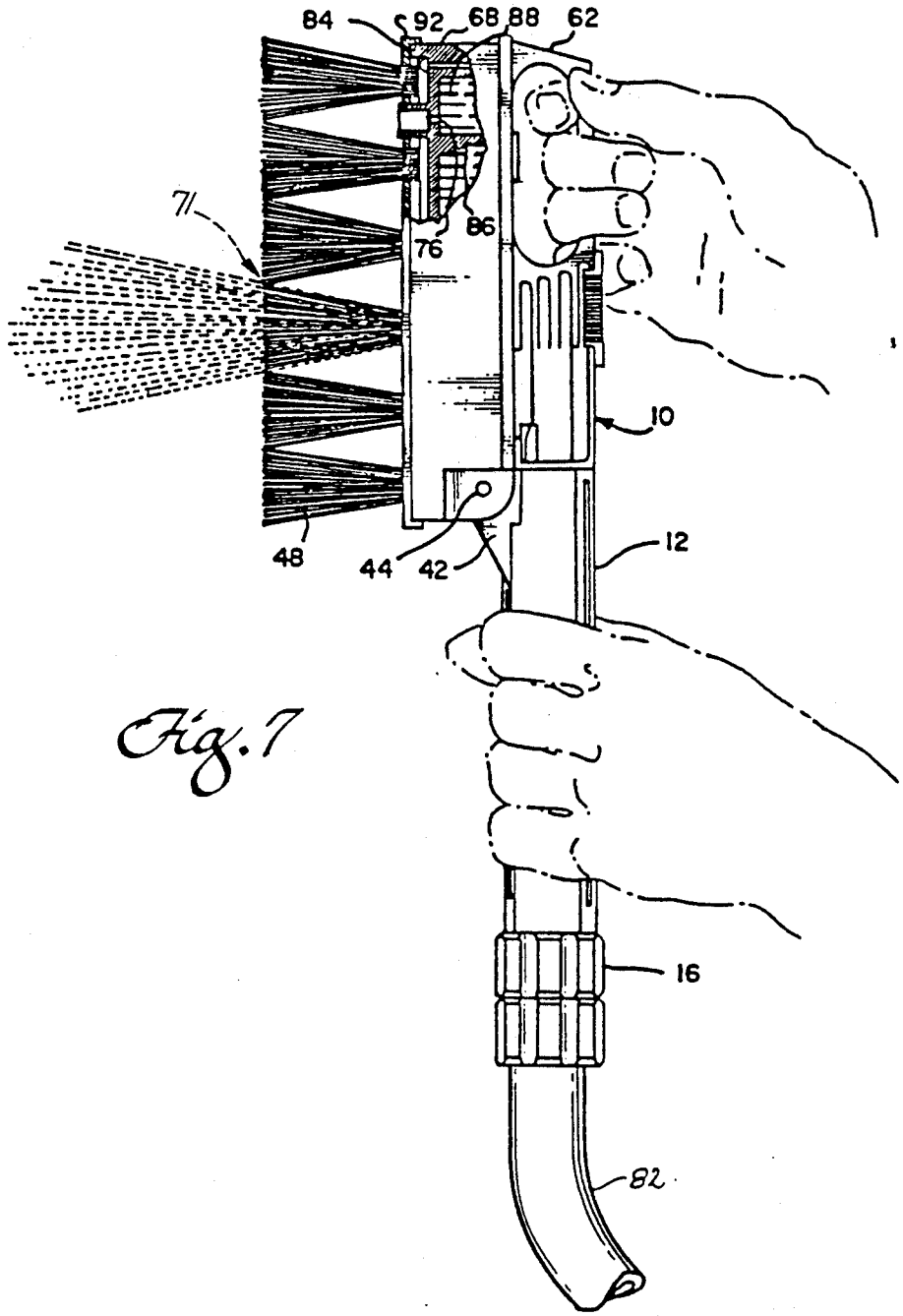
FIG. 7 is a side elevational view showing the cleaning element in use.

By contacting the surface to be cleaned with the bristles 49 of brush 48 the handle portion 12 and body or brush portion 14 will be pivoted about the pivot pin 44 to their aligned actuated positions in the manner illustrated in FIG. 6, thereby causing the rearward end 52 of the valve operating rod 46 to push against the flutter valve 28. This contact will force the flutter valve to leave its seat 26, whereby water will flow through the conduit 20 as indicated by the arrow 22 (FIG. 5), through the nozzle 70 and through opening 70' in the brush base or opening 70" in the sponge base for direct impingement upon the surface to be cleaned. To stop the flow of water, all that need be done is to remove the brush or sponge from contact with the surface being cleaned, whereby the water pressure will again force the members back to the deactuated condition and force the flutter valve 28 against its seat 26. As shown in FIG. 7, continuous flow of water through the cleaning implement 10, away from the user, can be achieved by grasping the handle portion 12 with one hand and the handle 62 of the body portion 14 with the other hand and then manually pulling and pivoting the parts to the axially aligned position of FIG. 5. In this position, as hereinbefore set forth, the flutter valve 28 will be forced from its seat 26 to thereby assure continuous water flow.

Figure 8:
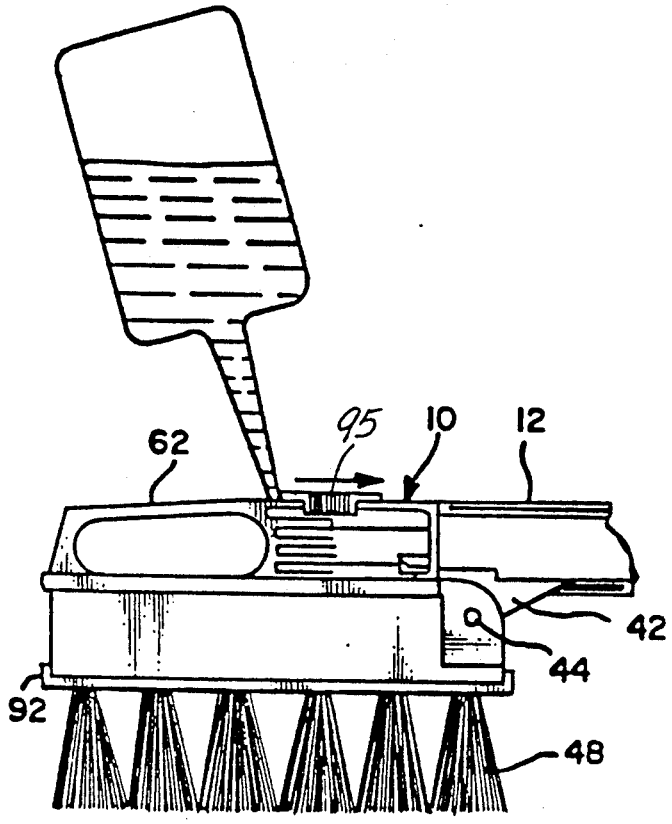
FIG. 8 is a side elevational view showing detergent being added to the cleaning implement.
Figure 13:
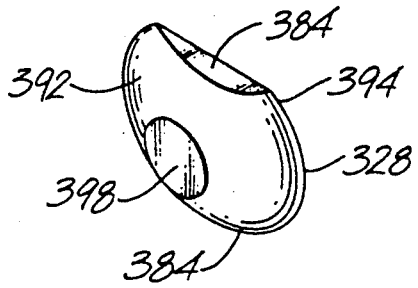
FIG. 13 is an enlarged isometric view of the flutter valve of FIGS. 11, 12 and 14.

FIG. 8 shows how the soap reservoir 78 can be refilled by pouring soap from a container into the reservoir through the fill opening 80. A sliding cap 93 seals the reservoir. As shown in FIGS. 5 and 6, the fill opening directs soap into the reservoir 78. Soap is dispensed by tilting the body portion 14 so that soap will flow over the weir 86, into the discharge chamber 88 and then out the opening 76.

FIGS. 9 through 14 show an alternate embodiment of the present invention that incorporates a normally closed valve into a cleaning implement. The implement has a handle portion or conduit 312 and a pivotally interconnected body portion or conduit 314. The handle portion 312 terminates at its rear in a water inlet, a threaded socket connector 316 which is designed for connecting to the threaded end of a typical garden hose 317 in the conventional manner. Along its length, the handle portion includes a handle 313 with finger grips **313*a*** so that the implement may be easily held by the user.

Figure 9:
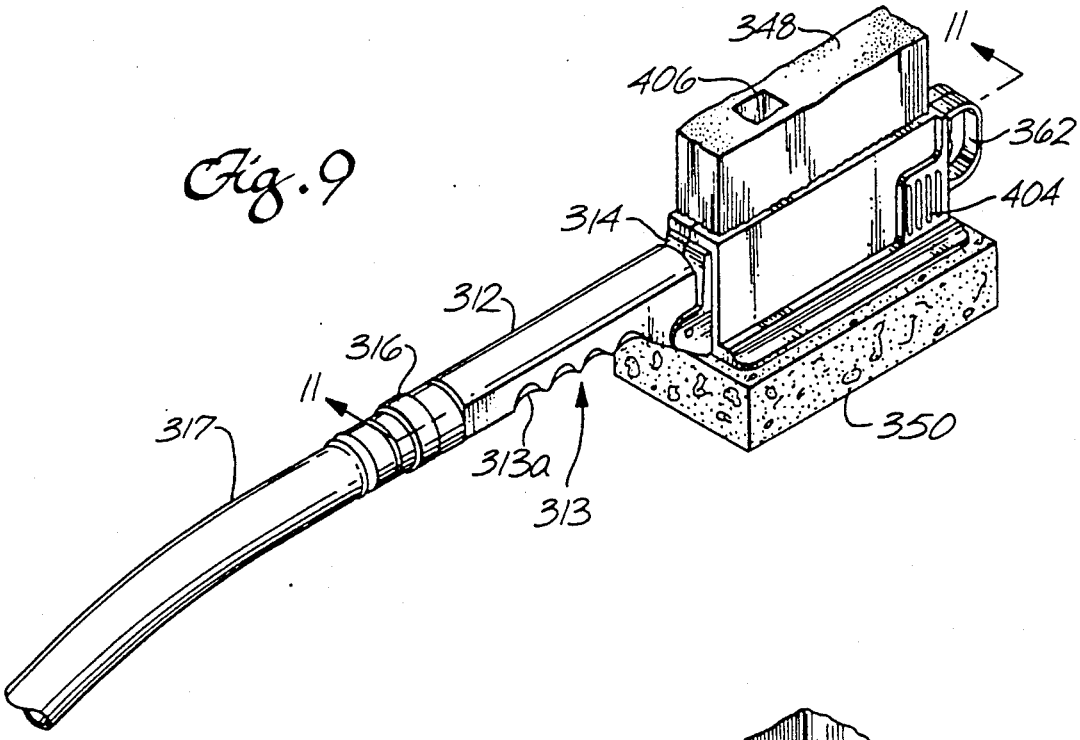
FIG. 9 is an isometric view of an alternate embodiment of a cleaning implement with automatic water shut-off and a reversible head in accordance with the present invention.
Figure 14:
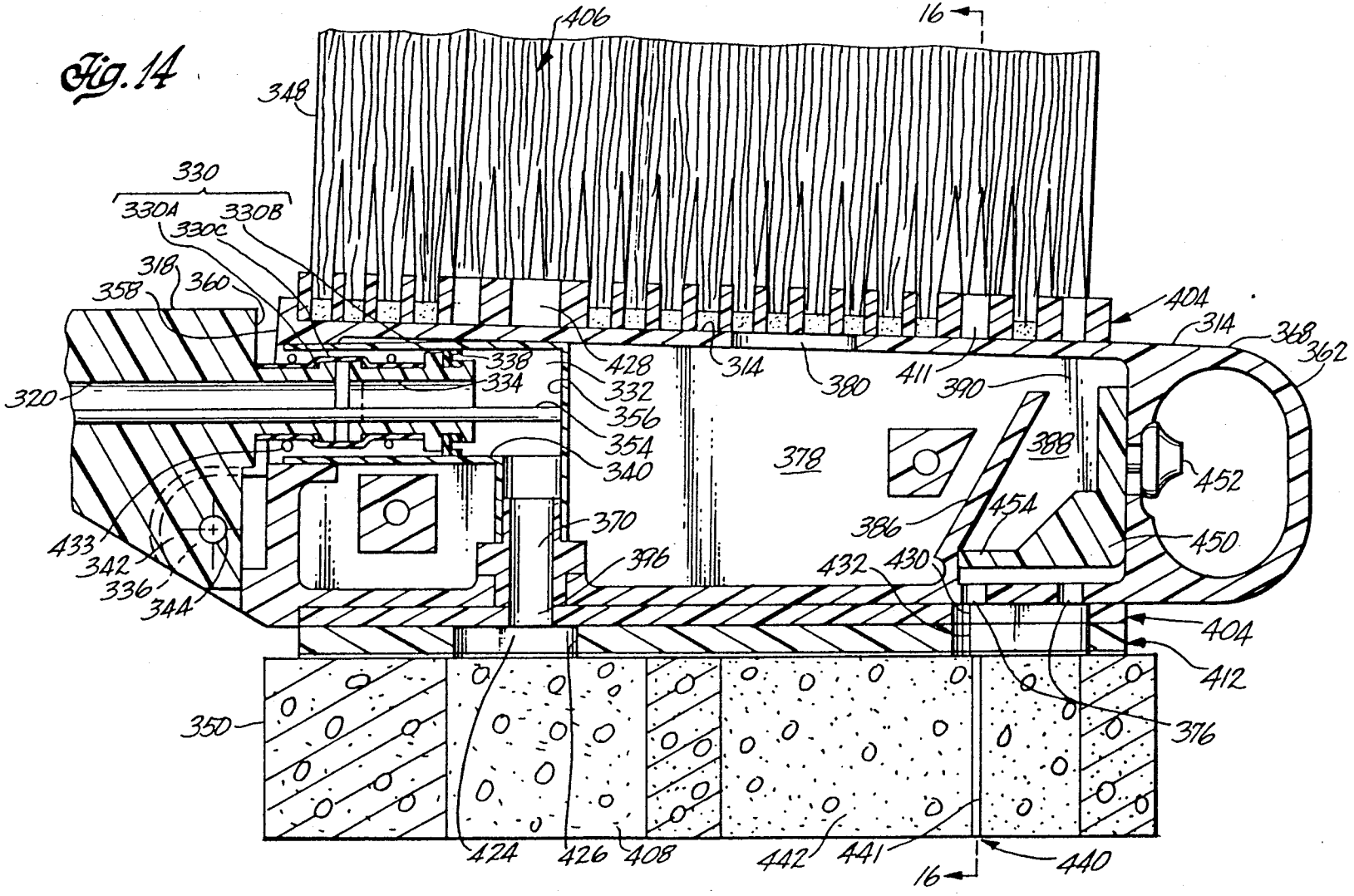
FIG. 14 is an enlarged view of a portion of the cleaning implement of FIG. 11 showing the cleaning head installed with the sponge on the bottom side for scrubbing and the soap valve open.
Figure 14A:
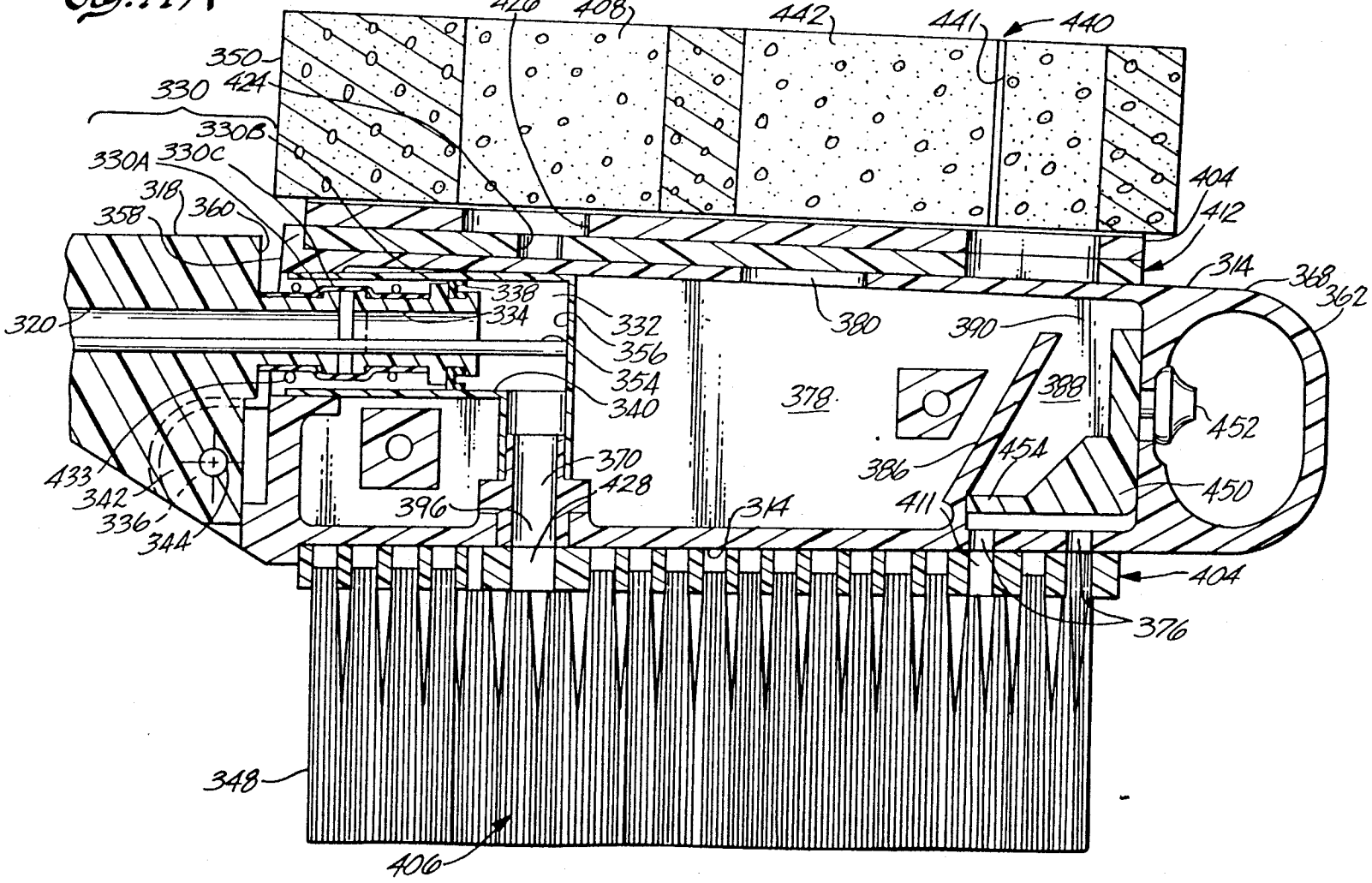
FIG. 14A is a view similar to FIG. 14 with the head reversed so that the brush is on the bottom side for scrubbing.

The present embodiment provides a reversible and removable head 404 which bears both a brush 348 and a sponge 350. The brush and sponge are mounted on oppositely facing sides of the exterior of the head. The head interior is hollow and rectangular in cross section and is configured to slidably mount on the similarly shaped exterior of body portion 314 and to be retained thereby a friction fit. The four exterior walls of the body portion 314 preferably converge towards the handle portion 312 as do the interior walls of the head 404. The head slides over the body portion 312 until the walls frictionally engage the body portion with a wedging action. The reversible head 404 is quickly released by sliding in the reverse direction separating the head and body portion. The head can be mounted so that the sponge is on the bottom side where water and soap are dispensed as shown in FIGS. 9 and 14. The head can then be removed, inverted and remounted on the body portion 314 so that the brush is at the bottom side where water and soap are dispensed as seen in FIG. 14A.

Figure 10:
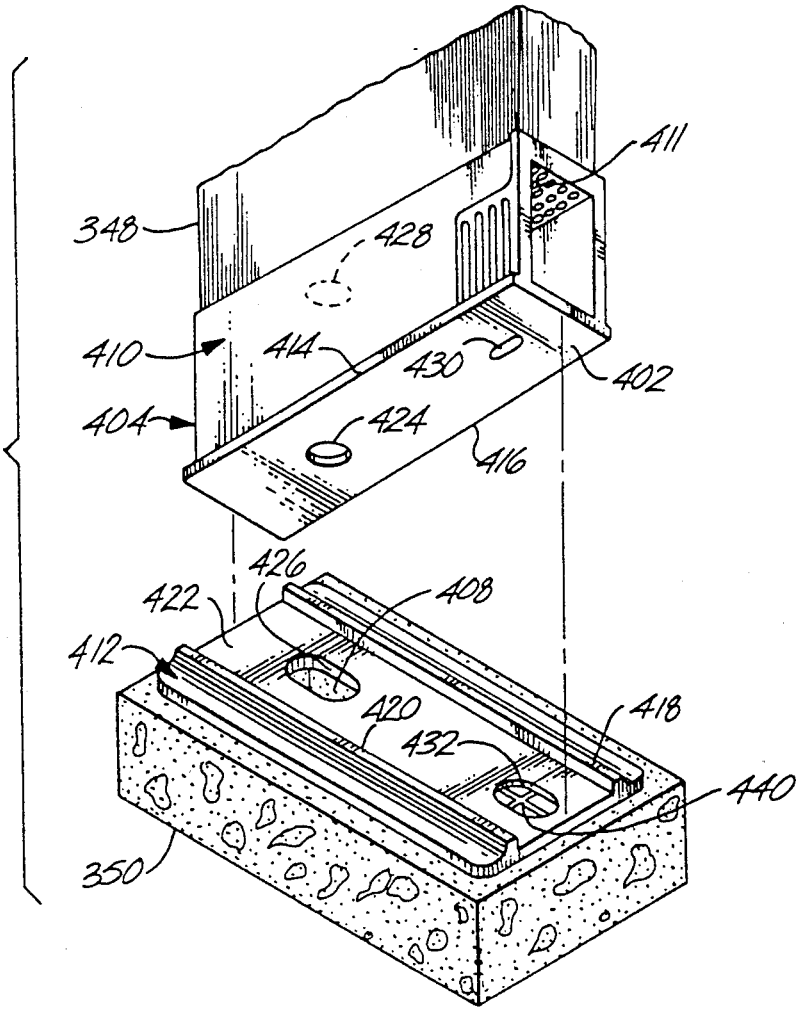
FIG. 10 is an exploded view of the cleaning head with a removable sponge used in the cleaning implement of FIG. 9.

Preferably the head 404 has two sections 410, 412 as shown in FIG. 10. The bottom wall 402 of section 410 has side flanges 414, 416 which converge towards one end of the section (towards the right in FIG. 10). Section 412 has ribs 418, 420 which converge towards one end of the section (towards the right in FIG. 10), thereby defining a tapered channel 422 within which the bottom wall 402 of section 410 can be slidably inserted until the side flanges 414, 416, frictionally engage the ribs 418, 420 by a wedging action. Should the brush 348 or sponge 350 wear out and require replacement, sections 410, 412 may be easily separated and replaced. Also, an assortment of sections 410 and 412 with different types of cleaning elements, different types of sponges or brushes of various stiffness, may be provided separately or in kit form.

FIG. 10 also shows port 424 in bottom wall 402, port 426 in section 412 and enlarged hole 408 in sponge 350 all aligned with fluid opening 396 of nozzle 370 (FIG. 14) when the head 404 is installed with the sponge at the bottom and allow water to pass through the sponge 350 to directly impinge on the surface to be cleaned. Similarly, when the brush is on the bottom, as seen in FIG. 14A, port 428 in section 404 and hole 406 through the brush bristles are aligned with nozzle 370 and allow water to pass through the nozzle 370 and openings 396, 406 and 428 and directly impinge on the surface being washed. The opening 406 in the bristles of the brush and the opening 408 through the sponge is sufficiently large, considering the focus of the spray and the thickness of the bristles and sponge, that a substantial portion or all of the fluid sprays directly through the openings to directly impinge on the surface to be rinsed, without striking the adjacent bristles and spray. Thus, very little or no soap is carried by the fluid to the surface during rinsing. Similar comments are true of the opening 71 in the bristles of the brush and the opening 72 through the sponge of the first embodiment of FIGS. 1-7.

Openings 430, 432 are provided in sections 410 and 412, respectively, to allow soap to flow from two soap discharge openings 376 (FIGS. 11, 12 and 14) to the sponge. When the brush is at the bottom, as in FIG. 14A, a single opening 411 in section 410 of brush base of section 410 allows soap to be dispensed therethrough from the reservoir 378 through the aligned opening 376, that is closest to weir 386.

Figure 11:
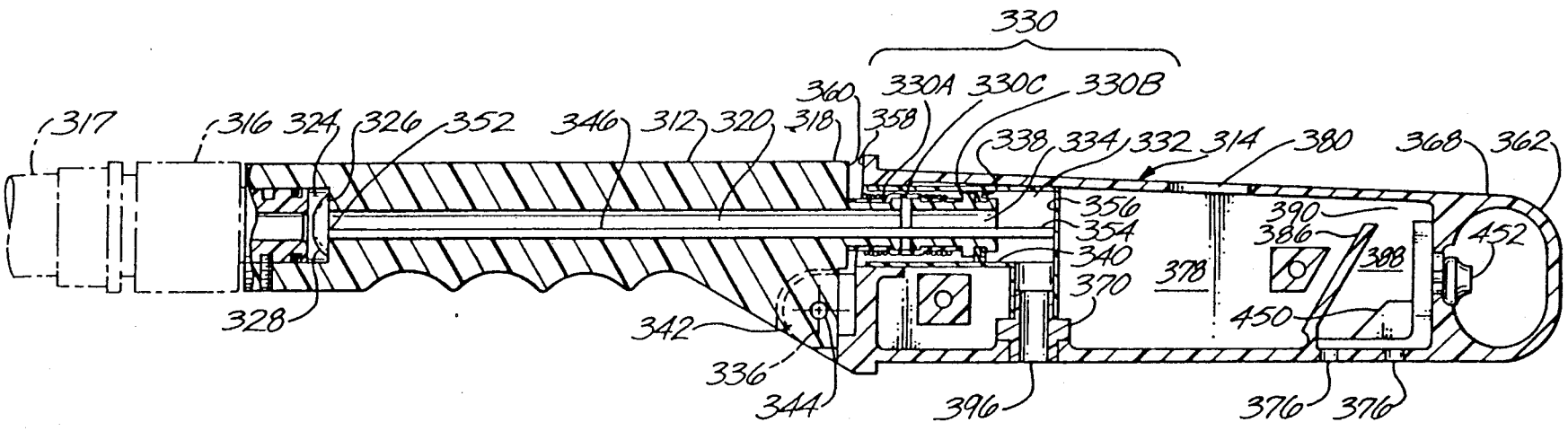
FIG. 11 is a cross sectional view taken along line 11—11 on FIG. 9 showing the arrangement of parts with the valve closed and the cleaning head removed.
Figure 12:
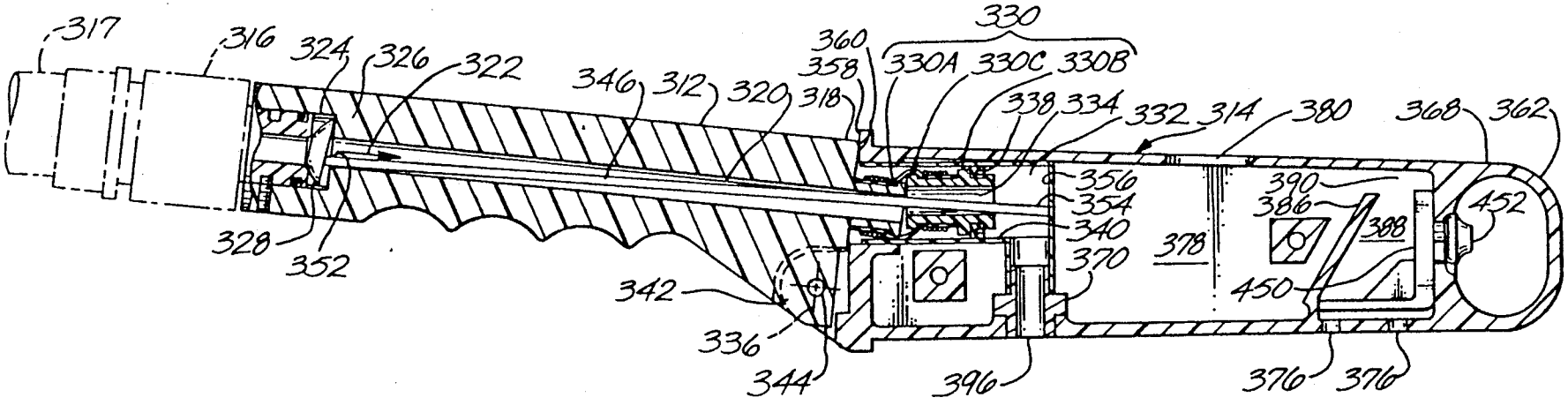
FIG. 12 is a cross sectional view taken along line 11—11 on FIG. 9 showing the arrangement of parts with the valve opened and the cleaning head removed.

As shown in FIGS. 11 and 12, the handle portion 312 is provided with an elongated axial water passageway 320 to permit pressurized fluid or water flow therethrough in the direction indicated by the arrow 322 (FIG. 12). The passageway 320 is in fluid communication with the threaded socket connector 316 and terminates at its rear in a baffle or valve chamber 324. The valve chamber is filled with water under all normal conditions of use. The forward end of the valve chamber 324 terminates in an annular valve seat 326. The valve seat 326 receives a baffle or flutter valve 328 which has a planar side that seals against the planar valve seat 326 as shown in FIG. 11. Preferably, the flutter valve 328 is not connected within the valve chamber 324 to the rod or to the chamber and is free to move within the chamber between seated and unseated positions to control the flow of water through the cleaning implement.

As illustrated in FIG. 11, when the cleaning implement is not in use, water under pressure will impinge upon the freely moving flutter valve 328, forcing the valve to press upon and seal against the valve seat 326 to the deactuated configuration or condition. When the flutter valve 328 is pressed against the seat 326, water cannot flow through the brush. As with the embodiment of FIGS. 1-8, the automatic shut-off is driven to a shut-off condition by the fluid pressure and requires no attention from the user.

The baffle or flutter valve 328 has a first face 392 oriented towards the water supply at the inlet end of the handle portion 312 and a second planar face 394 oriented towards the baffle or valve seat 326. While a flat valve may be used, see e.g. FIGS. 5 and 6, it is preferred that the first face 392 be convex. The valve of FIGS. 11-14 has a spherical surface with a flat end 398, the convex face reduces the force required to break the seal of the valve against the seat. The flat end of the valve of FIG. 13 can be selected to control the amount of force by the water tending to close the valve. The force required to force the valve off its seat is increased by increasing the area of end 398. The second face 394 of the valve is preferably planar. The plane of the surfaces 394 and 398 are preferably perpendicular to the axis of elongation of the water passageway through the handle portion. The shape and dimensions of the valve relative to that of the chamber are selected so as to allow the valve to move about without allowing it to become oriented in the wrong direction.

Preferably, the shape of the valve does not precisely match that of the water passageway through the valve seat. That is, the annular seat be regular in shape and the valve irregular. The valve seat of FIGS. 11 and 12 is preferably annular with an annular passageway through its center. The valve, however, has a circular second face with symmetrically oppositely facing cutouts 384. The cutouts reduce the distance from the valve perimeter to the passageway through the seat to enhance flow through the chamber when the valve is open. More specifically, the cut outs allow water flow around the valve as the valve is tilted by the rod, thereby reducing the force required to tilt the valve from the valve seat. While the valve configuration of FIGS. 11-14 is presently preferred, a similar effect can be achieved using other shapes and configurations in which the distance from the perimeter of the valve face 394 to its center varies.

Still referring to FIGS. 11-14, the forward end 318 of the handle portion 12 is coupled to a flexible nozzle 330 which extends into the body portion 314. The body portion 314 includes a cooperating chamber 332 to receive water under pressure from the handle portion 312. The nozzle 330 is formed by rigid conduit segments 330A, 330B which are spaced apart and coupled by a flexible tubing sleeve 330C. Flexible thin walled tubing is preferred. The sleeve is secured by wires 433 wrapped around the tubing and the tube segments. Tube segment 330A is an integral part of the handle portion 312. Tube segment 330B is sealed to the interior wall of chamber 332 by an annular shaped cup seal 338. The nozzle 330 includes an interior water conveying passageway 334, which forms an extension of the water passageway 320 and communicates between the valve chamber 324 and the body chamber 332. This forms a continuous water conduit, the nozzle portion of which is flexible. The conduit extends from the water inlet or threaded socket connector 316 through the water conduits 320, 332, 334 and out the slot shaped water discharge opening 396 of nozzle 370.

FIGS. 5 and 6 and 11-14 illustrate how the nozzle flexes to allow maintaining of the sliding sealed connection between the handle and body portions In FIGS. 11-14, the flexible tubing sleeve 330C flexes to allow the cup seal 338 to bear continuously against the inner periphery 340 of the wall of chamber 332 to maintain a sliding sealed connection as the handle and body portion pivot. The cup seal prevents any backflow or loss of water at the interconnection between the handle portion 312 and the body portion 314, as the handle and body portions pivot.

A lug 342 projects from the handle portion 312 below the water passageway 320 into a clevis defined by a pair of ears 336 (only one shown by hiding lines) formed in the body portion 314. A pivot pin 344 extends through the ears 336 and the lug 342 to allow limited pivotal movement, on the order of 5° between the handle portion 312 and the body portion 314.

As illustrated in FIG. 11, when the cleaning implement is in its initial, unused condition, the deactuated position, the rearward end 352 of valve operating rod 346 contacts the flutter valve 328 under water pressure. This automatically shuts off the water flow because the water passageway 320 is isolated by the flutter valve 328 from water introduced at the water inlet. In addition, the water pressure upon the flutter valve will cause the flutter valve 328 to push the operating rod 346 forwards. The operating rod's forward end 354, in turn, pushes against stationary barrier 356 causing the body portion 314 to pivot clockwise, relative to the handle portion, about pivot pin 344 to the position indicated in FIG. 11.

The pivot pin 344 is preferably located on the outside of the handle and body portions spaced apart from the fluid passageway. The operating rod 346 is preferably located within the fluid passageway and extends through the flexible tubing. The distance from the rod to the pivot pin is selected according to the angle through which the handle and body portions must be pivoted with respect to each other in order to open the valve.

The valve operating rod 346,; is normally fabricated of metal or hard plastic, and is free to move axially and transversely within the water passageway 320 and 334 and the passageway formed by chamber 332. Since the operating rod is free to move transversely within the water passageway, and since the rod has a much smaller cross section than the passageway, the rod will normally fall to one side of the passageway as shown in FIGS. 5, 6, 11, 12 and 14. The length of the operating rod 346 is selected so that its valve contacting rearward end 352 extends beyond the valve seat 326 when the handle and body portions are pivoted towards each other as in FIG. 13 and the rod is forced by the barrier 356 to move axially through the passageway. Since the operating rod normally lies to one side of the passageway, it will tilt the valve off of its seat. This also occurs in the embodiment of FIGS. 1–8. The water will then flow freely around the portion of the valve which is separated from the seat.

Referring to FIGS. 11 and 12, the body or brush portion 314 is formed with a generally hollow body 368 having a convenient handle 362 formed at the opposite end from the handle portion. The body 368 has a discharge nozzle 370 which terminates in a fluid discharge slot or opening 396. The nozzle 370 is in fluid communication with chamber 332 of the body portion 314. When the flutter valve 328 is upset or forced off of its seat 326, water flows through the handle portion 312, through chamber 332, and through the discharge nozzle 370 and opening 396 to the surface to be cleaned. The water changes direction within chamber 332 with no significant loss of pressure and exits the nozzle 370, preferably as a narrow wide stream of water due to the narrow opening 396. The nozzle can be made in a variety of shapes, depending on the type of water stream desired using techniques well known in the art. However, the nozzle is preferably selected to provide a stream of higher velocity than that of the fluid at connector 316.

Figure 15A:
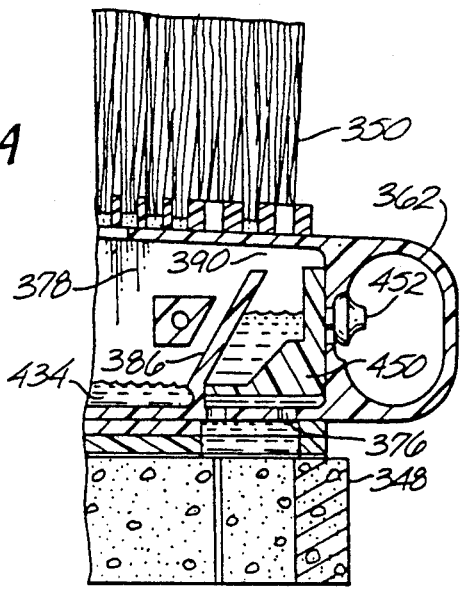
FIG. 15A is an elongated portion of the cross sectional view of FIG. 14 showing soap in the soap reservoir and the cleaning implement held horizontal.
Figure 15B:
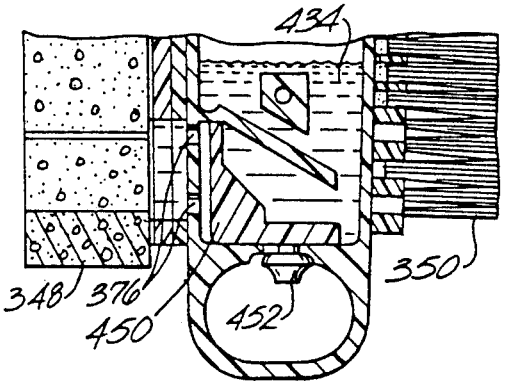
FIG. 15B is the cross sectional view of the cleaning implement of FIG. 15A showing the soap with the cleaning implement held vertically pointing downwards.

A liquid soap or detergent reservoir 378 is formed in the body 368 and is provided with a fill opening 380 through which the reservoir may be filled with conventional liquid soap or detergent 434 (FIG. 15A) to aid in the cleaning process. The port is covered by the reversible head 404 as shown in FIGS. 14 and 14A. An internal wall or weir 386 subdivides the detergent reservoir 378 to define a smaller soap discharge chamber 388. The weir 386 defines an upper soap passageway 390 between the top of the weir and the wall cf the body 368, between the chamber 388 and the larger reservoir portion, so that by tilting the body portion 314 downward, the liquid soap or detergent flows from the reservoir 378 into the soap discharge chamber 388 (FIG. 15B).

As shown in FIG. 14, the soap discharge chamber 388 is provided with gravity soap discharge openings or orifices 376 whereby any soap which is allowed to spill over into the soap discharge chamber 388 can flow by gravity through the discharge openings 376 and then into the brush or sponge for application upon the surface being cleaned.

In use, the sponge and brush normally become saturated with soap. The soap flow is regulated by tilting the cleaning implement and by using the L gate 450. Weir 386 subdivides the detergent reservoir into a soap discharge portion 388 with soap openings 376 and a reservoir portion so that the soap discharge portion is smaller than the reservoir portion. The weir extends from the bottom side of the soap reservoir upwards towards the top side of the reservoir. The weir is inclined towards the discharge openings 376. The incline weir ensures that soap is provided to the discharge openings in most operating angles of the cleaning implement.

Figure 15C:
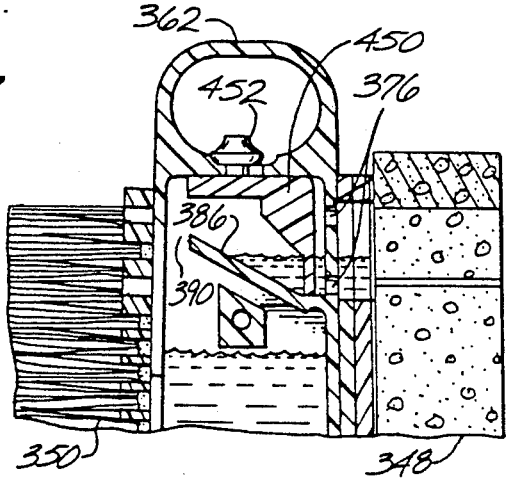
FIG. 15C is the cross sectional view of the cleaning implement of FIG. 15A showing the cleaning implement held vertically pointing upwards.

When the cleaning implement is held level (FIG. 15A) the weir holds a portion of the soap in the discharge chamber near the discharge openings. The amount of soap in the chamber is increased by tilting the implement, as explained above. When the implement is tilted vertically downward as shown in FIG. 15B, soap flows over the downward extending weir towards the lower end of the discharge chamber. It is preferred that a discharge opening be provided near the lower end of the soap discharge chamber closest to the body portion handle 362 so that soap is discharged from that opening even when the soap level in the reservoir is low. When the implement is pointed vertically upwards as shown in FIG. 15C the upward extending weir serves to trap or contain a supply of soap near the discharge openings 376. It is also preferred that the second discharge opening be provided near the base of the weir so that soap is provided at such discharge opening, even when the soap level in the discharge chamber is low. The weir may be curved towards the discharge openings either at a single bend as shown or curved to contain a supply of soap at the discharge openings when the implement is tilted to the various positions shown in FIGS. 15A, 15B, 15C can be used.

The head 404 has only one opening 410 from the soap discharge openings 376 to the brush. This is to limit the amount of soap flowing into the brush which offers little resistance to flow. On the other hand, there are two openings 430 to the sponge because the sponge tends to self-regulate the soap flow. The number of openings and their size can be varied to suit the characteristics of the particular cleaning element involved As long as the brush is on the bottom, below the soap discharge chamber 388, soap is provided to the brush.

When the brush is used for scrubbing, the bristles are agitated and the soap is dispersed throughout the brush and distributed over the surface being scrubbed. When the head 404 is reversed and the sponge 350 is positioned on the bottom beside the discharge openings soap flows to the sponge as described above with reference to FIG. 16.

Figure 16:
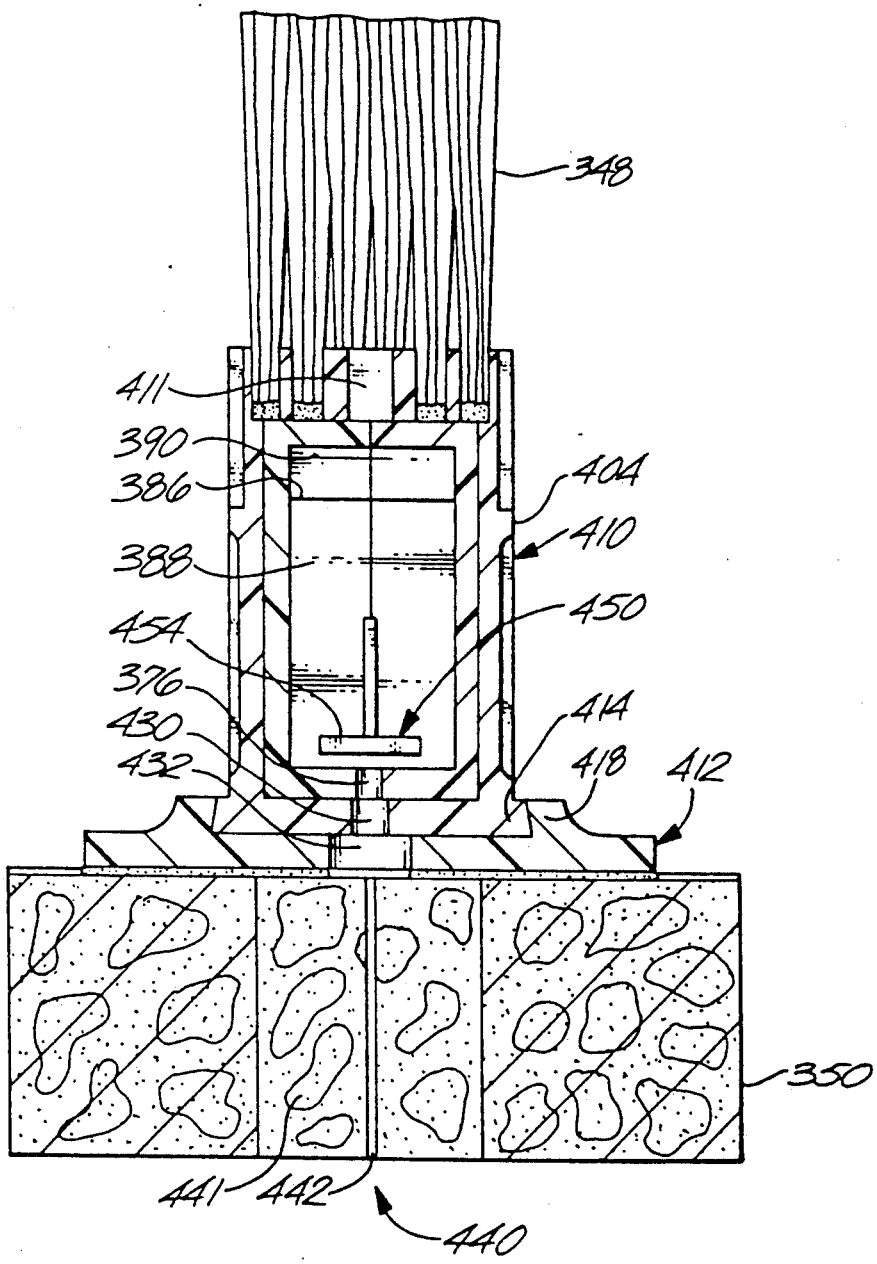
FIG. 16 is a cross sectional front view of the cleaning implement of FIG. 14 taken along the line 16—16 in FIG.14.
Figure 18:
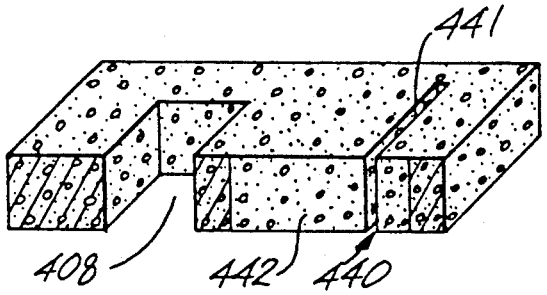
FIG. 18 is a perspective and cross sectional view of the sponge of FIG. 16 taken along line 18—18 in FIG. 17 removed from the head.

FIGS. 16 and 18 shows the slit 440 in the sponge which helps to disperse the soap throughout the sponge. The slit has a transverse portion 441 which extends, a substantial distance, preferably approximately ¾ way across the width of the sponge. Longitudinal portion 442 extend a substantial distance, preferably, approximately ½ way along the length of the sponge. The two portions have an intersection 444 which lies directly below one of the soap discharge openings 376. The intersecting slits provide large sponge surface areas through which the soap is distributed into the sponge 350. When the sponge is used for scrubbing, the sponge is moved, sliding the adjacent surfaces of the slits relative to each other, causing the soap to be dispersed throughout the sponge. The sponge also acts to regulate the soap flow. As the sponge becomes saturated it absorbs less soap. When completely saturated it will absorb very little additional soap and the soap flow is substantially stopped. When soap is then squeezed out of the sponge, for example, by pressing the sponge against a surface, the sponge will then absorb more soap. L-shaped gate 450 is used to further limit the soap flow and to prevent soap from leaking out in storage.

External button 452 is connected to gate 450 and when the two are raised to the position shown in FIGS. 12, 14 and 16, allow soap to drain around the bottom leg 454 of the gate through holes 376. When external button 452 and gate 450 are lowered to the position shown in FIG. 11, the lower leg 454 closes off and prevents any flow of soap through either of openings 376.

In use, the user holds the handle portion 312 in one hand and applies pressure through an attached cleaning element, such as the sponge or brush, to the surface to be cleaned. Ever so slight pressure applied between the body portion and the handle portion rotates the two portions from the deactuated condition or position in FIG. 11 to the actuated longitudinally aligned condition of FIG. 11. The actuated condition causes the valve, which is operatively coupled to the handle and body portions, to change from a deactuated to an actuated condition allowing water flow through the conduits in the handle and body portion to the nozzle 370 from which fluid is sprayed onto the surface to be cleaned. Release of the pressure by the person allows the fluid pressure against the valve to pivot the handle and body portions back to the non-aligned or deactuated condition of FIG. 11 causing the valve to block further fluid flow through nozzle 370.

To rinse, the user grasps the handle portion 312 in one hand and the handle 362 on the body portion in the other hand as illustrated in FIG. 7. The distance between the handle portion and handle of both embodiments is small enough to permit grasping the two simultaneously, one in each hand. Preferably, the distance is less than about 8 inches to 24 inches and preferably less than 16 inches to provide ease of hand holding and operation. Grasping the handle portion and handle on the body portions in this manner, the person rotates the two portions relative to each other, preferably toward the person, with the two hands causing movement from the deactuated condition to the actuated condition and, as a result, causing the valve to unblock water flow. The water then flows through the passageways of the conduits from the inlet 316 out of nozzle 370 away from the person, allowing the water to spray passed the cleaning element (i.e., brush or sponge) to and directly impinge on the surface. The clean spray of water rinses the surface without applying soap. When through rinsing, the person releases the pressure between the handle portion and handle on the body portion, allowing the two portions to rotate back to the deactuated condition and, thereby, cause the valve to block further water flow.

The clean water rinse is particularly useful because the brush and sponge are normally saturated with soap. If the water streaming from the nozzle were to be forced through the brush or sponge to the surface being rinsed, some soap would be carried to the surface being rinsed. Using the present invention the user can scrub or apply soap easily with the cleaning element and then move the cleaning element away for actuation by the user's two hands to spray clean rinse water at the surface being cleaned. The implement is made still more useful by the automatic operation of the valve. This assures an adequate supply of water when scrubbing to prevent the cleaning element from scratching the surface to be cleaned.

What has been disclosed, then, is a method for rinsing a surface with a cleaning element, having first and second relatively pivotal portions and a cleaning element on one of said portions. The steps are as follows: a user grasps in one hand one of the pivotal portions and in the other hand a second one of the pivotal portions and holds or suspends, as depicted in FIG. 7. The user then pivots the first and second pivotal portions relative to each other, while dispensing fluid past the cleaning element, away from the user, to directly impinge on the surface to the rinsed. As a result, a very simple and efficient method is disclosed for rinsing with a cleaning element.

The embodiments of FIGS. 1-8 and 9-16 involve a hand held scrubbing and rinsing implement. Each of the implements are hand holdable, are preferably made of molded plastic parts (except as discussed above, possibly the rod), and preferably weigh in the range of 1¾ pounds to 2 pounds, and more preferably less than 1½ pounds with an overall length of less than 12 to 28 inches and preferably less than 18 inches, allowing the user to easily hold and actuate the implement.

In each embodiment, a fluid conduit, including the handle and body portions and the passages therethrough, have an inlet and an outlet between which fluid is passed. The connector at the inlet end of the handle portion is for coupling the inlet to a source of fluid. A resilient cleaning element is coupled to the conduit for scrubbing a surface to be cleaned. A nozzle in each embodiment passes a spray of fluid from the outlet, passed the cleaning element, so as to directly impinge on the surface being cleaned while the brush is removed from the surface.

Figure 7A:
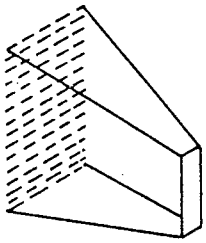
FIG. 7A is a perspective view of the fan shaped spray of water from the nozzle of the cleaning element of FIG. 7.
Figure 17:
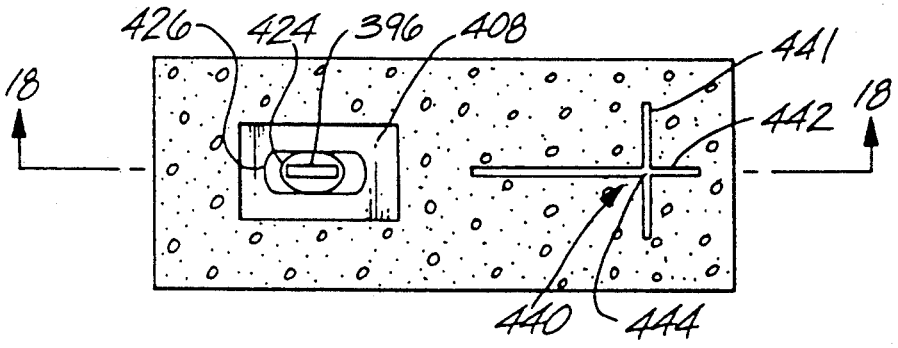
FIG. 17 is a bottom view of the sponge of FIGS. 9, 10 and 14 showing the nozzle opening and the soap slit, the separation in the slit is exaggerated for purpose of illustration.

Preferably, the nozzle is adapted to provide a thin, fan shaped spray of fluid past the cleaning element as illustrated in FIG. 7 and 7A. The embodiments each have a rectangular opening at the end of the nozzle, such as depicted at 70 in FIGS. 3 and 4, of the embodiment of FIGS. 1-8 and depicted at 396 in FIG. 17 of the embodiment of FIGS. 9-16. The rectangular opening is preferably substantially longer in the longitudinal direction than it is wide and, as a result, creates a long substantially rectangular and spreading spray along its 4 sides as generally illustrated in FIG. 7 and 7A. It should be understood that the opening may also be oval or other shaped to create a fan shaped spray to facilitate rinsing of the surface being washed. Preferably, the spray fans out so that when the cleaning implement is approximately 1 foot from the surface to be rinsed, the spray is approximately 1 foot along its longest dimension, as seen in FIG. 7A.

The implements of FIGS. 1–8 and 9–16 and each of the cleaning elements has a scrubbing side, such as the ends of the bristles in the brushes and the downward facing side of the sponge, with an opening through the cleaning element and the side. The cleaning element has an opening, such as opening 73 in the base of the brush of FIG. 3, opening 75 in the base of the sponge of FIG. 4 and opening 408 through the sponge of FIG. 14, adapted to permit the spray of fluid to pass through the element and directly impinge on the surface being rinsed.

The handle portion is grasped by the user to hold the implement and apply pressure to the surface to be cleaned through the cleaning element. The valve is a controllable valve that is controlled to pass fluid flow through the conduit. The valve of both embodiments is normally closed and is adapted to pass fluid through the conduit upon application of a pressure between the handle and the surface through the cleaning element. The valve is normally closed against the seat in the passage, thereby blocking fluid flow. The fluid pressure urges the valve to the closed condition, stopping fluid flow until opened as discussed above.

Although the invention has been described with a certain degree of particularity, it is understood that the present disclosure has been made only by way of example and that numerous changes in the details of construction and the combination and arrangement of parts may be resorted to without departing from the spirit and scope of the invention as defined in the claims. The present disclosure has emphasized a water valve for use with a cleaning implement. However, the valve disclosed herein is suitable for a variety of applications using a variety of fluids. Accordingly, the fluid source need not be a garden hose.

What is claimed is:

1. A cleaning implement for separately scrubbing and rinsing a surface comprising:

a handle portion having a rinsing fluid inlet;

a body portion pivotably connected to the handle portion and pivotable with respect to the handle portion at the connection between an actuated position and a deactuated position, the body portion having a handle, a cleaning element for scrubbing the surface, and a nozzle for applying rinsing fluid to the surface substantially without the rinsing fluid contacting the cleaning element;

a fluid conduit extending from the handle portion inlet to the body portion nozzle; and a valve for allowing flow through the conduit when the body portion is in the actuated position and for preventing flow through the conduit when the body portion is in the deactuated position, the handle portion and the body portion handle being relatively disposed so that a user may grasp each one, one in each hand, and move the body portion to the actuated position, thereby causing rinsing fluid to be directed out of the nozzle away from the user for rinsing the surface.

2. The implement of claim 1 wherein the body portion handle is moved away from the direction of flow out the nozzle to move the body portion to the actuated position.

3. The implement of claim 1 wherein the handle is disposed at an end of the body portion opposite the pivotable connection to the handle portion.

4. The implement of claim 1 wherein the cleaning element substantially surrounds the nozzle and defines a discharge opening in the cleaning element at the nozzle through which rinsing fluid passes substantially without contacting the cleaning element.

5. The implement of claim 1 further comprising a soap dispenser for dispensing soap onto the cleaning element.

6. The implement of claim 1 wherein the body portion comprises a soap outlet for dispensing soap onto the cleaning element, and wherein the cleaning element comprises a sponge having at least one slit in communication with the soap outlet for enhancing penetration of soap from the outlet into the sponge.

7. The implement of claim 6 wherein the sponge has a second slit intersecting the first slit.

8. The implement of claim 1 wherein the body portion is normally in the deactuated position.

9. The implement of claim 8 wherein the rinsing fluid inlet is adapted to connect to a source of fluid under pressure and the body portion is adapted to be biased toward the deactuated position by the fluid pressure.

10. A cleaning implement for alternately scrubbing and rinsing a surface comprising:

a handle portion having a rinsing fluid inlet;

a body portion pivotably connected to the handle portion and pivotable at the connection between an actuated position and a deactuated position;

a cleaning element on the body portion disposed so that a user may grasp the handle portion in one hand and apply the cleaning element against a surface for scrubbing the surface while at the same time moving the body portion to the actuated position by applying pressure through the handle portion against the surface;

a nozzle on the body portion disposed for applying rinsing fluid to the surface when scrubbing the surface;

a fluid conduit extending from the handle portion inlet to the body portion nozzle;

a valve in the conduit for allowing flow through the conduit when the body portion is in the actuated position and for preventing flow through the conduit when the body portion is in the deactuated position; and a handle on the body portion disposed so that a user may grasps the handle and the body portion handle, one in each hand, to move the body portion to the actuated position and thereby operate the valve to direct fluid out the nozzle for rinsing the surface.

11. The implement of claim 10 wherein the nozzle is situated with respect to the cleaning element so that rinsing fluid directed out of the nozzle does not substantially contact the cleaning element.

12. The implement of claim 10 wherein the cleaning element substantially surrounds the nozzle and defines a discharge opening in the cleaning element at the nozzle through which rinsing fluid passes substantially without contacting the cleaning element.

13. The implement of claim 10 wherein the body portion is normally in the deactuated position.

14. The implement of claim 13 wherein the rinsing fluid inlet is adapted to connect to a source of fluid under pressure and the body portion is adapted to be biased toward the deactuated position.

15. A method of rinsing a surface with a cleaning element having a handle portion and a body portion pivotably connected together and a cleaning element on the body portion, the method comprising:

grasping the handle portion with a first hand of a user;

grasping the body portion with a second hand of a user to hold the cleaning element suspended from the surface; and pivoting the handle portion and the body portion with respect to each other, using the hands, to cause rinsing fluid to be dispensed through a nozzle in the body portion to the surface.

16. A method for alternately scrubbing and rinsing a surface with a cleaning implement having a handle portion and a body portion pivotably connected together and a cleaning element on the body portion, the method comprising:

grasping the handle portion with one hand of a user and pressing the cleaning element against the surface to scrub the surface and to pivot the body portion with respect to the handle portion, thereby causing rinsing fluid to be dispensed through a nozzle in the body portion to the surface; and alternately grasping the handle portion with one hand of a user and the body portion with another hand of a user to hold the cleaning element suspended from the surface and to pivot the body portion with respect to the handle portion to cause rinsing fluid to be dispensed from the nozzle to the surface substantially without contacting the cleaning element.

* * * * *